United States Patent [19]

Watanabe et al.

[11] 3,986,074

[45] Oct. 12, 1976

[54] LUMINOUS RADIATION PANEL APPARATUS

[75] Inventors: Masanori Watanabe, Katano; Kinzo Nonomura, Kadoma, both of Japan

[73] Assignee: Matsushita Electric Industrial Co., Ltd., Osaka, Japan

[22] Filed: June 11, 1975

[21] Appl. No.: 585,838

Related U.S. Application Data

[62] Division of Ser. No. 336,063, Feb. 26, 1973, Pat. No. 3,904,905.

[30] Foreign Application Priority Data

| | | |
|---|---|---|
| Feb. 28, 1972 | Japan | 47-20880 |
| Feb. 29, 1972 | Japan | 47-21352 |
| Nov. 22, 1972 | Japan | 47-117395 |
| Nov. 22, 1972 | Japan | 47-117396 |
| Nov. 22, 1972 | Japan | 47-117397 |
| Dec. 28, 1972 | Japan | 48-3366 |
| Dec. 28, 1972 | Japan | 48-3367 |
| Dec. 28, 1972 | Japan | 48-3368 |

[52] U.S. Cl. ..... 313/485; 313/220; 313/489

[51] Int. Cl.[2] ..... H01J 63/04

[58] Field of Search ..... 313/485, 486, 487, 489, 313/493, 188, 201, 220

[56] References Cited

UNITED STATES PATENTS 3,878,422 4/1975 Brown et al. ..... 313/486 X

*Primary Examiner*—R. V. Rolinec
*Assistant Examiner*—Darwin R. Hostetter
*Attorney, Agent, or Firm*—Stevens, Davis, Miller & Mosher

[57] ABSTRACT

An improved luminous radiation panel apparatus of the type in which no separator is used between two substrates and which is thus simple to manufacture, free from erroneous discharge, longer in life and capable of producing a stable discharge. Furthermore, the apparatus has high resolution and brightness and there is no possibility that the excitation of a selected phosphor simultaneously excites the adjacent phosphors. The apparatus is adapted to make a display in color and is suited as a display device, particularly as a television apparatus or character display device.

3 Claims, 12 Drawing Figures

LUMINOUS RADIATION PANEL APPARATUS

This is a division of application Ser. No. 336,063 filed Feb. 26, 1973, now U.S. Pat. No. 3,904,905.

The present invention relates to a luminous radiation panel apparatus, and more particularly to an apparatus which utilizes the phenomenon of electric discharge.

Various types of luminous radiation panel apparatus utilizing the phenomenon of electric discharge have been proposed and their application to practical use has been under way. In known apparatus of this type, as for example illustrated in FIG. 1 of the accompanying drawings, an insulating separator 4 having a large number of holes 3 arranged regularly in rows and columns is disposed between an insulating substrate 1 constituting the back side and a transparent glass substrate 2 constituting the front side. The separator 4 is formed on one surface thereof with a plurality of grooves 5 each thereof interconnecting the holes 3 in one column. An electrode 6 consisting of a metal wire is disposed in each of the grooves 5. A plurality of grooves 7 extending perpendicular to the grooves 5, i.e., in the direction of the breadth, are formed on the other surface of the separator 4 and a wire electrode 8 is disposed in each of the grooves 7. These component parts are brought together as a unit which is put to use after the whole unit has been enclosed and hermetically sealed by a glass seal or the like. In this process, an inert gas is also filled in each of the holes 3 in the separator 4 under a pressure ranging from several tens mm $H_g$ to several hundreds mm $H_g$.

In this prior art apparatus, when a DC or AC voltage is applied between a selected one of the plurality of electrodes 6 and a selected one of the plurality of electrodes 8, a luminous discharge occurs in that hole 3 located at the intersection of the selected electrodes. In this apparatus, the purpose of the separator 4 is to prevent the occurrence of discharge between the electrodes other than the selected ones and to protect the substrates 1 and 2 from being damaged or deformed under the influence of atmospheric pressure.

In other words, the provision of the separator 4 is essential in known apparatus of this type because in such apparatus a bias voltage higher than the discharge voltage is preliminarily applied to each of the electrodes 6 and 8 in consideration of the ease of the occurrence of discharge and discharge area and the fact that an inert gas is filled at a pressure considerably lower than the atmospheric pressure as mentioned above. Therefore, there is a tendency to cause a discharge between the adjacent electrodes 6 and 8. Namely, without the provision of the separator 4, misoperation occurs causing a discharge between the adjacent electrodes 6 and 8.

However, the provision of such a separator makes the manufacture of apparatus of this type considerably difficult and therefore apparatus having such a separator cannot be put to practical use.

In known apparatus of this type, their life is dependent on the deterioration of negative electrodes and therefore the selection of material for negative electrodes has been a very important factor with the prior art apparatus. Particularly, where the pressure of the contained gas is low, deterioration of the negative electrodes due to sputtering occurs, causing a reduction in the life of the apparatus, a reduction in the transmission factor of the light produced by the discharge due to the deposition of the sputtered metallic atoms on the surface of the substrates 1 and 2 and the occurrence of inter-electrode short-circuit.

The materials generally used in the manufacture of such negative electrodes include nickel, iron, cobalt alloys, platinum, etc. However, these materials are disadvantageous in that they are subject to sputtering, liable to cause variation in the discharge conditions with the discharge time; particularly where the evaporation deposited negative electrodes are used, it is possible to maintain a stable discharge only for about several or several tens of hours.

On the other hand, where it is desired to effect the display in color in known apparatus of this type, it has been customary to irradiate a phosphor with a ultraviolet ray produced by the discharge, thus producing a luminous color which is dependent upon the nature of a particular phosphor used. Since the ultraviolet ray produced by the discharge at the intersection of a negative electrode and a positive electrode radially diverges similarly as the visible light, it is necessary to reduce the distance between a phosphor and a source of ultraviolet ray as near as possible, if the same area of the phosphor as the discharge area must be caused to luminesce. According to one form of heretofore proposed apparatus, a phosphor is coated on the inner wall of holes formed in a separator provided to confine the discharge area, while in another form of such heretofore proposed apparatus a phosphor is provided in the form of a doughnut around the discharge area. In contrast, the principal object of the present invention is to eliminate the provision of any separator which confines the discharge area. The prior art apparatus of the former type is impractical, while a disadvantage of the latter prior art apparatus is that a large portion of generated ultraviolet ray is radiated in the direction vertical to the negative electrode or positive electrode surface and a very small proportion of the generated ultraviolet ray is radiated along the surface of each electrode with the result that a small proportion of the ultraviolet ray is radiated onto the doughnut-shaped phosphor provided around the discharge area; hence the luminous brightness is decreased.

It is therefore an object of the present invention to provide a luminous radiation panel apparatus which eliminates the use of separator, excludes the danger of the substrates breaking down aand becoming distorted, and prevents the occurrence of erroneous discharge between the electrodes adjacent to selected electrodes and which is longer in life and ensures stable discharge and higher resolution.

It is another object of the present invention to provide a luminous radiation panel apparatus which is capable of producing a light of high brightness, preventing the excitation of phosphors adjacent to a selected one, and effecting the display in color.

Many other objects and advantages of the present invention will become apparent from considering the following detailed description in conjunction with the accompanying drawings, in which.

The present invention will now be described in greater detail with reference to the accompanying drawings.

Figure 1:
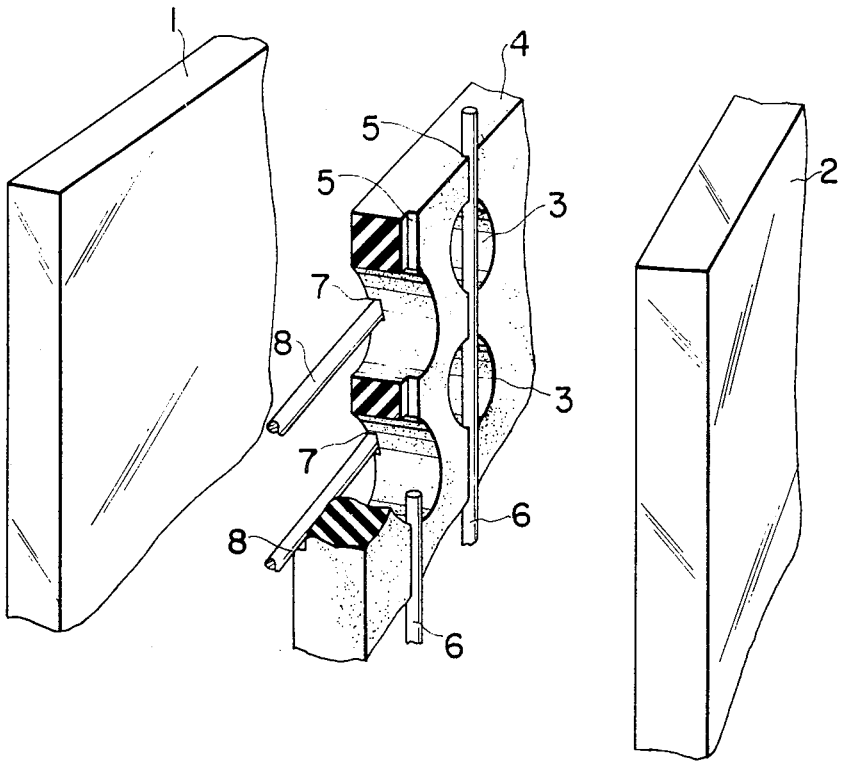
FIG. 1 is a schematic view of a prior art luminous radiation panel apparatus.
Figure 2:
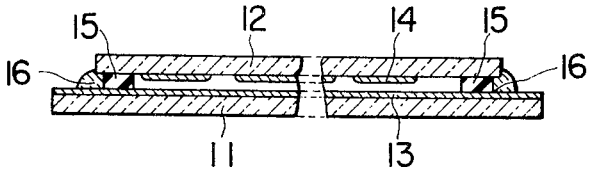
FIG. 2 is a side sectional view of an embodiment of a luminous radiation panel apparatus according to the present invention.
Figure 3:
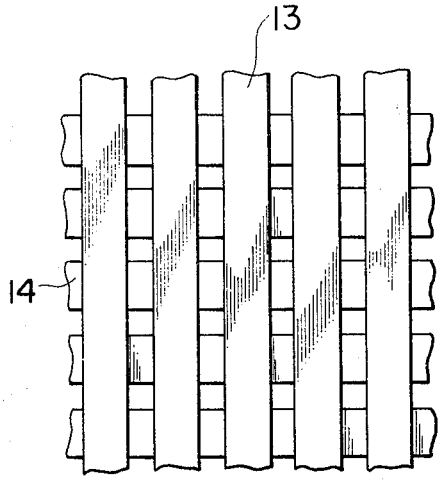
FIG. 3 is a plan view of FIG. 1 showing an example of the arrangement of the electrodes in the apparatus of FIG. 2.

In the embodiment shown in FIG. 2, numerals 11 and 12 designate insulating substrates made of ceramic, glass or the like and having on the respective surfaces thereof a plurality of first and second electrodes 13 and 14 made of parallel strips of metal, such as, nickel or aluminum having a width not exceeding several millimeters and formed by the evaporation or printing process. Numeral 15 designates spacers made of ceramic, glass or the like which keep the first and second substrates 11 and 12 apart from each other at a predetermined distance as will be explained later. Numeral 16 designates a sealing member attached by an adhesive, e.g., epoxy resin to enclose and hermetically seal the first and second substrates 11 and 12 and the spacers 15. As shown in FIG. 3, either of the first and second electrodes 13 and 14 are arranged vertically in the illustration and the other is arranged substantially perpendicular to the former.

If one of the substrates 11 and 12, e.g., the second substrate 12 is transparent, then it is preferable that the second electrodes 14 are also transparent. The transparent electrodes may be made of a material such as $SnO_2$ or $In_2O_3$. A gas, e.g., a mixed gas of neon and argon gases through which discharge occurs upon application of a relatively low voltage, is filled between the first and second substrates 11 and 12 at a pressure on the order of 760 mm Hg. The distance between the electrodes 13 and 14 is selected such that the product of the distance therebetween and the pressure of the gas provides a minimum firing potential. In other words, if a neon-argon mixture gas is employed, the product of the pressure of the gas and the distance between the electrodes 13 and 14 must be within the range between 5 to 20 mm Hg.cm to provide the minimum firing potential. Therefore, if the gas is filled at a pressure of about 760 mm Hg, then the distance between the electrodes 13 and 14 must be between 0.065 and 0.25 mm. Though the value of this distance is considerably small as compared with the width of the electrodes 13 and 14, it is still sufficient to produce a locally controlled discharge.

In the apparatus constructed as above described, if a positive polarity pulse, for example, is applied to a selected one of a plurality of the first electrodes 13 and a negative polarity pulse is applied to a selected one of the plurality of the second electrodes 14 in synchronism with the positive polarity and if, in this case, the absolute value of the pulses is selected such that the sum of their absolute values exceeds the firing potential but the absolute value of the individual pulse is lower than the firing potential, then the discharge is established only at the intersection of the selected electrodes. In this way, by sequentially applying the pulse voltage in the respective groups of the electrodes 13 and 14, the luminous spots can be obtained all over the surface of the panel in response to the applied signals, thereby displaying any desired image. If it is arranged so that the peak value or width of the pulse varies in accordance with the input signal, the brightness of respective spots may be varied and hence an image of good tone may be obtained.

In the luminous radiation panel apparatus according to this embodiment, the pressure of the contained gas is substantially equal to 760 mm Hg and therefore there is no danger of the apparatus breaking down or becoming deformed under the influence of the atmospheric pressure. Furthermore, the fact that the pressure of the contained gas is selected high, is a great advantage since the diffusion of the plasma of the discharge can be confined to a very narrow area.

It has been found experimentally that the diffusion of the plasma of the discharge does not spread out from the end of an electrode beyond a distance which is approximately equal to one between two adjacent electrodes, if the gas pressure is on the order of 760 mm Hg. Accordingly, if the distance between the adjacent electrodes is selected approximately equal to or greater than the distance between the opposed electrodes, it is possible to prevent the plasma of the discharge from diffusing and spreading to the adjacent electrodes and thus causing misoperation. This eliminates the use of a separator which has heretofore been used to confine the discharge area.

This point will be explained further in some detail. As is known in the art, the Paschen's law states that the value of the firing potential is minimum at a certain value of the product of the pressure $p$ of a contained gas and the distance $d$ between two electrodes. Accordingly, in the case of the previously described mixed gas of neon and argon, if the pressure of the contained gas is 760 mm Hg, then the firing potential assumes a minimum value when the distance between the electrodes 13 and 14 is within the range from 0.065 to 0.25. On the other hand, since the width of the electrodes 13 and 14 is generally on the order of 0.5 to 1 mm, a locally controlled discharge can still occur satisfactorily even though the distance between the electrodes 13 and 14 is selected considerably small as compared with the width of the electrodes. This has been confirmed by the results of the experiments conducted by the inventors. Namely, the area of the discharge was about 0.06 $mm^2$ (0.3 mm in diameter) when the pressure of the gas was 760 mm Hg and the discharge could occur between the electrodes of 0.4 mm in width. Thus, practically no plasma of the discharge was allowed to spread out from the edges of the electrodes and it was found that if the spacing between adjacent electrodes were selected about the same as the distance between the opposed electrodes, the plasma of the discharge would not diffuse to the adjacent electrodes, causing an erroneous discharge between the electrodes and the adjacent electrodes.

With the apparatus constructed as above described, particularly where the pressure of the gas is low or the discharge current is increased considerably, a so-called jittering may be caused where the area of the cathode spot increases or the cathode spot rapidly moves over the surface of the negative electrode. As a result, the discharge area apparently spreads out to the outside of the intersection of the selected electrodes. The problem of such a phenomenon may be overcome by a method of coating an electrode with an insulating material excepting that portion of the electrode where discharge should take place, thereby limiting the discharging portion of the electrode.

Figure 4:
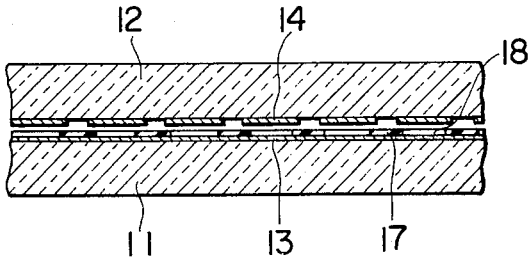
FIG. 4 is an enlarged side sectional view showing a modified form of the apparatus of FIG. 2.
Figure 5:
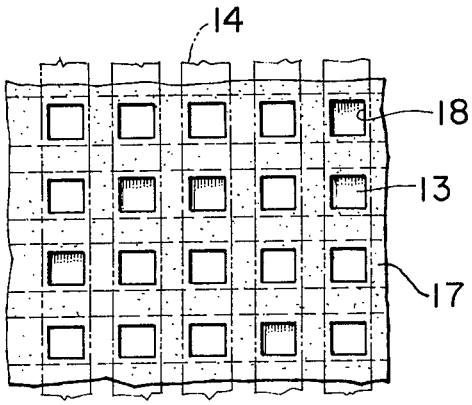
FIG. 5 is a plan view of the electrode arrangement in the apparatus of FIG. 4.
Figure 6:
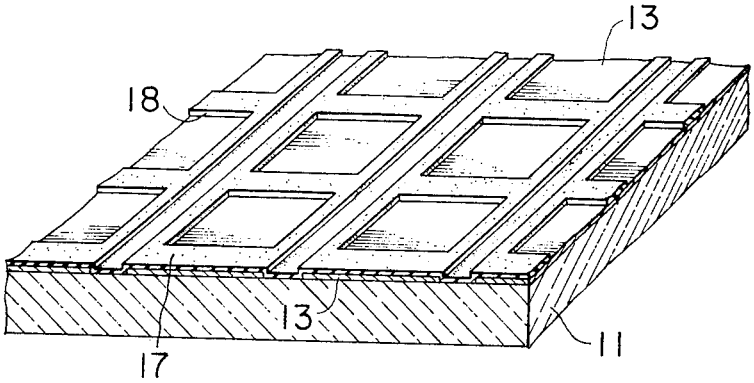
FIG. 6 is a perspective view of the apparatus of FIG. 4 showing its first substrate side.

FIG. 4 illustrates an enlarged view of the electrodes 13 and 14. Let it be assumed for purposes of description that the first electrodes 13 on the first substrate 11 are used as the negative electrodes and the second electrodes 14 on the second substrate 12 are used as the positive electrodes. In the figure, numeral 17 designates an insulating coating consisting of a coating of an insulating material, e.g., silicon dioxide ($SiO_2$) which is applied by the evaporation or printing process, for example. The insulating coating 17 is provided, as shown in FIG. 5, with a plurality of openings 18 at those portions where the first electrodes 13 are placed opposite to the second electrodes 14 so as to partially expose the electrodes 13. The openings 18 need not be formed into any particular shape. By selecting the minimum spacing between the openings 18 substantially equal to or greater than the distance between the electrodes 13 and 14, it is possible to prevent the spreading out of the plasma from the discharge portion to the adjacent portions to cause the occurrence of erroneous discharge.

While the above description has been made with reference to the case where the apparatus is operated on a DC current, both electrodes 13 and 14 may be coated with an insulating material excepting those portions which are opposed to each other so that an AC signal may be applied between the electrodes 13 and 14 to cause a discharge therebetween.

Figure 7:
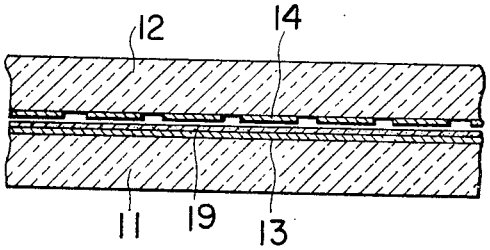
FIG. 7 is an enlarged side sectional view showing another modification of the apparatus shown in FIG. 2.

FIG. 7 illustrates an enlarged sectional view of another embodiment of the apparatus of the invention wherein a protective coating 19 of an oxide of a rare earth element is applied for example on the surface of the first electrodes 13 (constituting the negative electrodes) exposed to the space containing the gas.

In the luminous radiation panel apparatus of this embodiment, the application of the protective coating 19 of the rare earth element oxide on the surface of the electrodes 13, i.e., the negative electrodes exposed to the space containing the gas, has the effect of preventing damage to the first electrodes 13 due to the sputtering providing a longer life therefor, and also the effect of preventing a rise in the firing potential which is believed due to the influence of impurity gases entered through the sealing member 16 into the space containing the gas or the occurrence of a local arc-like discharge at the intersection of the electrodes 13 and 14, thereby stabilizing the discharge.

The oxide of the rare earth element constitutes a semi-conducting coating which, though its specific resistance is high at room temperature, may be used as a material for negative electrodes since the total resistance over the surface of the coating may be reduced satisfactorily if the coating is applied in a thickness ranging from 500 to 2000 A. The oxides of rare earth elements suitable for the protective coating 19 include cerium oxide ($CeO_2$), terbium oxide ($Tb_4O_7$), neodymium oxide ($Nd_2O_3$) and samarium oxide ($Sm_2O_3$). Also, an alloy of cerium and nickel and an alloy of cerium and cobalt as well as zirconium oxide are suitable materials for the protective coating 19. The oxides of rare earth elements are heat resisting materials and thus they also have an advantage in that in the manufacturing process of electrodes these materials can be subjected for example to heat treatment in an oxygen atmosphere (e.g., in the atmospheric pressure) and therefore the treatment can be accomplished without the danger of the electrodes becoming oxidized, thereby considerably reducing the manufacturing cost.

The experiments conducted by the inventors showed that with the luminous radiation panel apparatus constructed as shown in FIG. 7, wherein the first electrodes 13 were made of nickel and the cerium oxide protective coating 19 of about 1000 A thick was applied on the surface of the first electrodes 13 exposed to the space containing the gas, the life of the apparatus was about 500 times that of the conventional apparatus of the type employing no protective coating on the surface of the first electrodes 13 and the discharge characteristic was also stable.

Figure 8:
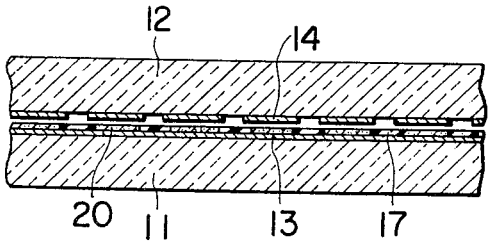
FIG. 8 is an enlarged side sectional view showing a modified form of the apparatus shown in FIG. 4.

FIG. 8 is a modified form of the apparatus of FIG. 4, wherein a protective coating 20 consisting of a rare earth element oxide is applied on the surface of the first electrodes 13 exposed to the space containing the gas. While, in this modification, the protective coating 20 has been applied to expose the insulating coating 17 to the space containing the gas, the protective coating 20 may be applied to cover the insulating coating 17. The same materials as used in the apparatus of FIG. 7 may also be used for the protective coating 20.

In the luminous radiation panel apparatus of this embodiment, since the first electrodes 13 constituting the negative electrodes have been covered by the insulating coating 17 excepting those portions intersecting the second electrodes 14 constituting the positive electrodes and since the protective coating 20 has been applied on the surface portions of the first electrodes 13 which were not covered by the insulating coating 17, i.e., exposed to the space containing the gas, there is no danger of the first electrodes 13 suffering damage due to the sputtering. Moreover movement of the luminous spot at the first electrodes 13 can be prevented, thus ensuring a longer life and a stable discharge.

Figure 9:
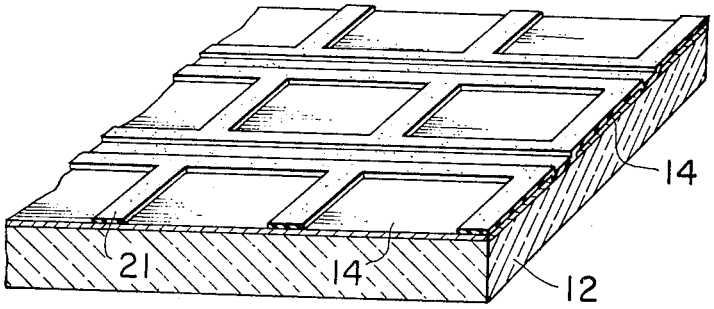
FIG. 9 is a perspective view showing the second substrate side of another modification of the apparatus shown in FIG. 2.

FIG. 9 illustrates an enlarged perspective view of another modification of the apparatus shown in FIG. 2, wherein an insulating coating 21 consisting of silicon dioxide ($Si\ O_2$), for example, is applied on the surface of the second electrodes 14 constituting the positive electrodes excepting those portions which intersect the first electrodes 13 constituting the negative electrodes.

In the luminous radiation panel apparatus of this embodiment, by virtue of the insulating coating 21 covering the second electrodes 14 excepting those portions intersecting the first electrodes 13, the discharge area formed on the surface of the second electrodes 14 is confined within narrow limits, thereby effecting the display with higher resolution.

Next, a luminous radiation panel apparatus according to the present invention which is adapted for color display, will be explained with reference to FIG. 10.

Figure 10:
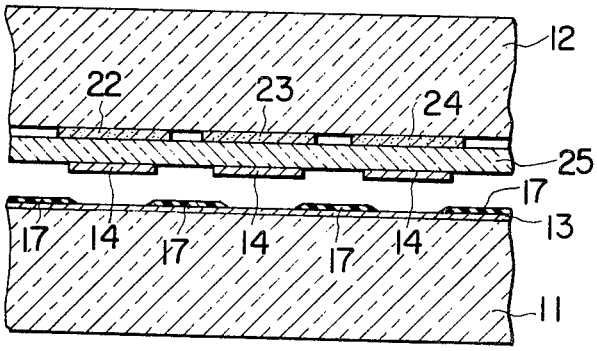
FIG. 10 is an enlarged side sectional view of another embodiment of the apparatus according to the invention which is adapted for color display.

In FIG. 10, numerals 22, 23 and 24 respectively designate, for example, stripes of red, green and blue phosphors for producing respectively red, green and blue colored lights, and the phosphor stripes 22, 23 and 24 are arranged side by side in the vertical direction with respect to the illustration. These phosphors may also be arranged in the form of dots. Numeral 25 designates a thin transparent sheet of glass applied in the front of the phosphor group and capable of transmitting ultraviolet rays therethrough, and numeral 14 designates a plurality of stripes of transparent electrodes each consisting of a Nesa coating, indium oxide coating or the like which are placed on the glass sheet 25 and arranged in the same direction and in parallel with the phosphor stripes. The spacing between the electrodes 14 is made smaller than the width of the electrodes. A plurality of electrodes 13 are arranged substantially perpendicular to the electrodes 14.

In this arrangement, when a discharge occurs between the electrodes 13 and 14 at the intersection thereof, since the phosphor stripes 22, 23 and 24 are arranged to oppose one of the electrodes, a large portion of the ultraviolet ray generated due to the discharge is applied to the phosphor stripes 22, 23 and 24, thereby ensuring a very high brightness. Further, since the glass sheet 25 is so thin that the distance between the discharge area and the phosphor stripe 22, 23 or 24, respectively, is reduced with the result that the ultraviolet ray is utilized effectively and it is possible to prevent the occurrence of a so-called blurring phenomenon where the adjacent phosphor stripes other than the selected one are also excited and caused to produce light. Furthermore, the phosphor stripe is not deteriorated by the ultraviolet ray generated due to the discharge, since the glass sheet is placed on the front surface of the phosphor stripe.

Figure 11:
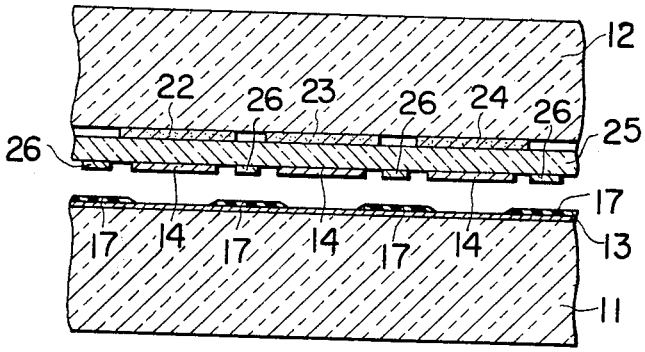
FIG. 11 is an enlarged side sectional view showing a modified form of the apparatus shown in FIG. 10.

The apparatus of FIG. 11 is identical with the apparatus shown in FIG. 10 excepting that a coating 26 of a material which prevents the transmission of ultraviolet ray therethrough is provided between the second electrodes 14. In the apparatus of FIG. 10, there is the danger that a portion of the ultraviolet ray may fall on the adjacent phosphor stripes which constitute picture elements thus causing the phosphor stripes other than the desired one to produce light. In the apparatus of FIG. 11, the provision of the ultraviolet ray preventive coating 26 between the second electrodes 14 completely prevents the ultraviolet ray produced at the discharge area from leaking obliquely and hence there is no possibility of the adjacent phosphor stripes constituting other picture elements being excited and caused to produce light.

Figure 12:
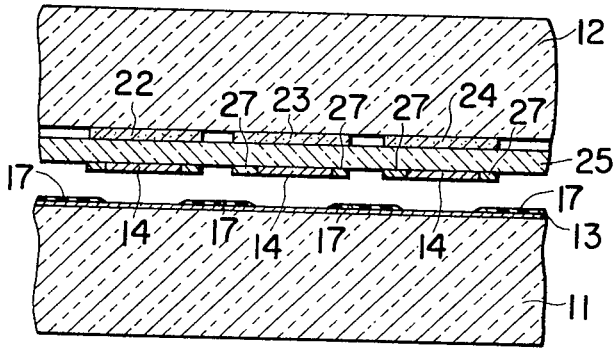
FIG. 12 is an enlarged side sectional view showing another modification of the apparatus shown in FIG. 10.

The embodiment of FIG. 12 differs from the apparatus of FIG. 10 in that an opaque conductive metallic coating 27 is provided on each side of the respective second electrodes 14. In this way, it is possible to completely prevent any portion of the ultraviolet ray generated at the discharge area from leaking obliquely and exciting and causing the adjacent phosphor stripes to produce light. Furthermore, the provision of the coating 27 has the effect of considerably reducing the resistance value of the second electrode 14 which generally has a high resistance. Accordingly, as compared with the transparent electrode, the voltage drop of such an electrode is small, thereby preventing so called brightness irregularity in which the brightness is not equal between the right and left sides of the picture. Particularly, where it is desired to display a large picture or it is necessary to reduce the width of the transparent electrodes to obtain an improved resolution, the aforementioned effects provide great advantages.

What we claim is:

1. A panel luminous radiation apparatus of the type in which light is produced by a discharge through a space containing a gas at the respective intersections of a plurality of electrodes disposed on a substrate and another plurality of electrodes disposed on another substrate to oppose and intersect one another with said first-mentioned plurality of electrodes, wherein a plurality of phosphor stripes or dots are applied at least to one of said substrates at positions opposite to said plurality of electrodes on said one of said substrates, and a thin sheet of glass capable of transmitting ultraviolet ray therethrough is applied to said phosphors.

2. A panel luminous radiation apparatus according to claim 1, wherein a ultraviolet ray preventive coating is disposed between said plurality of electrodes arranged on said glass sheet on said one of said substrates.

3. A panel luminous radiation apparatus according to claim 1, wherein one polarity side of said plurality of electrodes on said glass sheet comprises a transparent electrode, and a conductive metallic coating is disposed on a portion of said transparent electrode.

* * * * *